US005504820A

United States Patent [19]

Koizumi

[11] Patent Number: 5,504,820

[45] Date of Patent: Apr. 2, 1996

[54] TELEVISION RECEIVER WITH STEREO SPEAKERS

[75] Inventor: Hiroshi Koizumi, Saitama, Japan

[73] Assignee: Sony Corporation, Tokyo, Japan

[21] Appl. No.: 396,357

[22] Filed: Feb. 28, 1995

Related U.S. Application Data

[63] Continuation of Ser. No. 159,985, Nov. 30, 1993, abandoned.

[30] Foreign Application Priority Data

Nov. 30, 1992 [JP] Japan ..... 4-320956

[51] Int. Cl.[6] ..... H04R 5/00

[52] U.S. Cl. ..... 381/24; 381/159

[58] Field of Search ..... 181/199, 153, 181/156

[56] References Cited

U.S. PATENT DOCUMENTS 5,119,429 6/1992 Chatelain ..... 381/90

5,274,709 12/1993 Koizumi ..... 381/24

5,361,380 11/1994 You et al. ..... 381/24

FOREIGN PATENT DOCUMENTS 2-277400 11/1990 Japan ..... 381/24

*Primary Examiner*—Forester W. Isen

*Assistant Examiner*—Ping W. Lee

*Attorney, Agent, or Firm*—Peter C. Toto; Jerry A. Miller

[57] ABSTRACT

In a television receiver having a pair of speakers provided at the right and left sides of its image display portion, respectively, for reproducing the stereo audio signal by the speakers, one of the pair of speakers is constituted by the speaker unit for reproducing the middle and high frequency range of the stereo audio signal, and the other of the pair of speakers is constituted by the speaker unit for reproducing all frequency range of the stereo audio signal which is superior in reproduction characteristics of the low frequency range audio signal than that of the speaker unit for reproducing the middle and high frequency range.

6 Claims, 2 Drawing Sheets

TELEVISION RECEIVER WITH STEREO SPEAKERS

This is a continuation of application Ser. No. 08/159/985 filed on Nov. 30, 1993, now abandoned, which is hereby incorporated by reference.

BACKGROUND OF THE INVENTION

1. Field of the Invention

The present invention generally relates to television receivers and, more particularly, is directed to a television receiver accommodating therein speakers capable of reproducing stereo sound.

2. Description of the Related Art

Various types of television receivers have heretofore been developed in which speakers capable of reproducing stereo sound are mounted. In the television receiver with such stereo speakers, a pair of speaker units are provided at the right and left sides of an image display portion usually constituted by a cathode ray tube (CRT) or the like and right and left channel audio signals are supplied to the right and left side speaker units, respectively, so that the stereo sound is reproduced from the right and left side speaker units. According to the thus constituted television receiver capable of reproducing the stereo sound, the reproduction of the stereo sound with presence can be performed.

Recently, efficiency of the speakers accommodated in the television receivers have been improved so as to improve the frequency characteristics of the sound reproduced by the speakers. The conventional television receivers have employed speaker units of relatively small sizes as speakers to be accommodated therein to thereby perform sound reproduction with corresponding quality. There is a recent demand that been a sound is reproduced with a high quality when the viewer views a video program reproduced through television broadcast or a video tape. To this end, speakers of relatively large sizes have been mounted in the television receiver. One approach to provide a speaker with a high quality is, for example, to improve the reproduction characteristics of a low frequency range thereof so that low frequency sound of several tens Hz which has scarcely been reproduced in the conventional television receivers can be reproduced with good quality. One method for improving the reproduction characteristics of the low frequency range is to use speaker units of relatively large diameters and accommodate the speaker units in speaker cabinets.

However, if speaker systems of the high efficiency are accommodated in the television receiver, manufacturing cost of the television receiver will be disadvantageously increased due to the speaker systems. This is because the speaker system with good frequency characteristics or the like is expensive and hence it is not preferable to use such speaker systems for the television receiver in view of the manufacturing cost thereof. In particularly, since the television receiver of a type for reproducing the stereo sound requires two speaker systems for the right and left channels in total, manufacturing cost of the television receiver will be twice as much as a television receiver having only one speaker system for reproducing a monaural sound.

Further, in view of the constructions of the television receiver, it is not preferable to accommodate the speaker system with a high efficiency in the television receiver. To be more concrete, since, in general, the speaker system with a high efficiency is large in size, the television receiver will also be large in size when a speaker cabinet of a large size or the like is accommodated in the television receiver. In this case, since the television receiver of the type for reproducing the stereo sound requires the two speaker systems, a space for accommodating the speaker systems for the television receiver will be twice as much as a television receiver having only one speaker system for reproducing the monaural sound. As a consequence, the television receiver for the stereo reproduction will be larger in size when compared with the television receiver for reproducing the monaural sound.

OBJECTS AND SUMMARY OF THE INVENTION

Therefore, it is an object of the present invention to provide an improved television receiver capable of reproducing the stereo sound in which the aforementioned shortcomings and disadvantages encountered with the prior art can be eliminated.

More specifically, it is an object of the present invention to provide a television receiver capable of reproducing the stereo sound which can improve the efficiency of the speakers without substantially increasing the manufacturing cost thereof or increasing a space for mounting the speakers.

As an aspect of the present invention, there is provided a television receiver having a pair of speakers provided at the right and left sides of its image display portion, respectively, for reproducing a stereo audio signal by the speakers, wherein one of the pair of speakers is constituted by a speaker unit for reproducing middle and high frequency ranges of the stereo audio signal, and the other of the pair of speakers is constituted by a speaker unit for reproducing all frequency range of the stereo audio signal which is superior in reproduction characteristics of a low frequency range audio signal than that of the speaker unit for reproducing the middle and high frequency ranges.

In this respect, preferably, the low frequency components of one of the right and left channel audio signals constituting the stereo audio signal are mixed with the audio signal of the other channel and the mixed audio signal is reproduced from the speaker unit for reproducing the all frequency range.

Further, more preferably, the speaker unit for reproducing the all frequency range is accommodated in a speaker cabinet having a port for phase-inverting inner air and radiating the phase-inverted air externally through the port.

Furthermore, preferably, the speaker cabinet for accommodating the speaker unit for reproducing all frequency range is extended from a front panel of a cathode ray tube serving as the image display portion toward a space at the rear side of the cathode ray tube.

When reproducing the stereo audio signal, the signal with directivity is the relatively high frequency components, while the relatively low frequency components have little directivity. Accordingly, the stereo feeling can not be degraded even when the relatively low frequency components of the stereo audio signals are reproduced only from one of the right and left side speakers.

Further, in this case, since the low frequency components of one of the right and left channel audio signals constituting the stereo audio signal are mixed with the audio signal of the other channel and the mixed audio signal is reproduced from the speaker unit constituting the other speaker corresponding to the other channel, the low frequency component of the right and left channels constituting the stereo sound can be reproduced with good quality by the other speaker.

Furthermore, in this respect, since the speaker unit of the all frequency range reproduction type constituting the other speaker is accommodated in the speaker cabinet, the low frequency component can be reproduced with good efficiency and good quality.

The preceding and other objects, features, and advantages of the present invention will become apparent from the following detailed description of an illustrative embodiment thereof when read in conjunction with the accompanying drawings.

DETAILED DESCRIPTION OF THE PREFERRED EMBODIMENT

Figure 1:
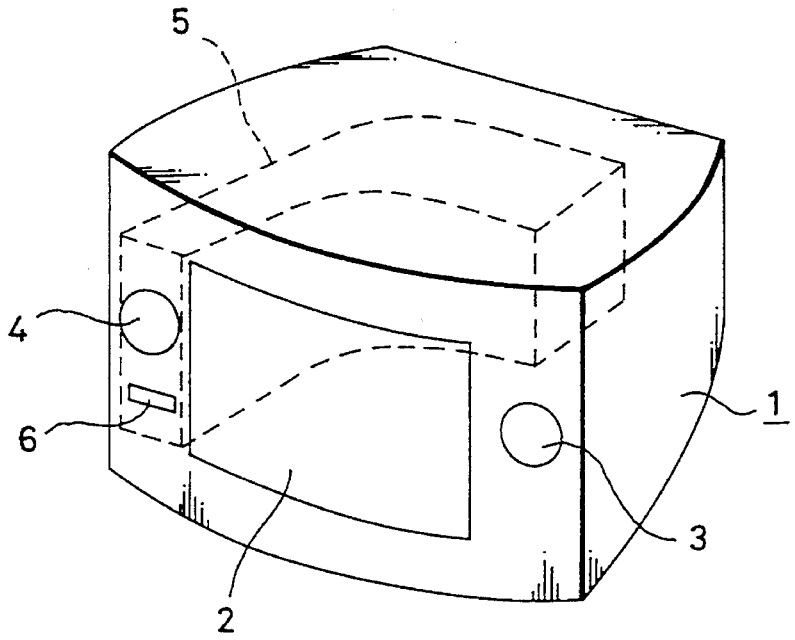
FIG. 1 is a schematic perspective view illustrative of a television receiver according to an embodiment of the present invention.
Figure 2:
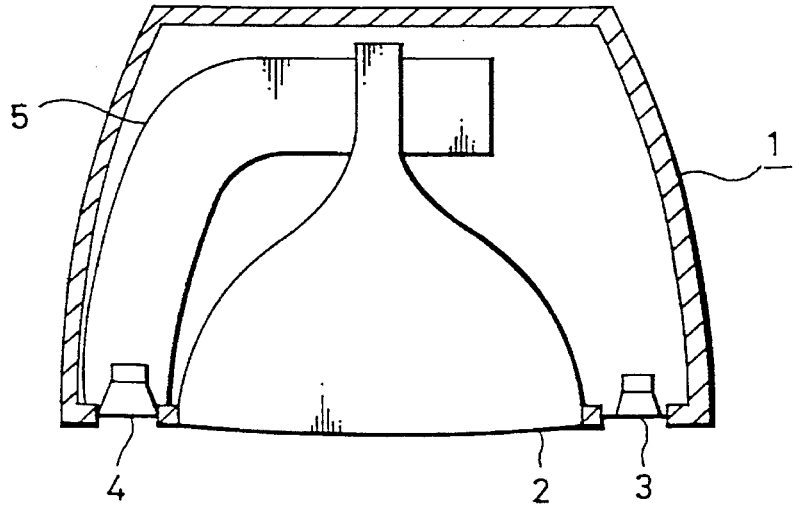
FIG. 2 is a schematic sectional view illustrative of the inner portions of the television receiver shown in FIG. 1.

A television receiver according to an embodiment of the present invention will now be described with reference to FIGS. 1 to 3, in which case, the present invention is applied to a television receiver capable of reproducing a stereo audio signal. FIG. 1 shows a perspective view of the television receiver in which a speaker system according to the embodiment of the present invention is mounted.

Referring to FIG. 1, a television receiver 1 includes a cathode ray tube 2 serving as the image display portion provided at the center portion of a front panel of the television receiver, and speakers 3 and 4 provided at the right and left sides of the cathode ray tube 2. The speaker 3 disposed at the right side of the front panel of the television receiver 1 when viewed toward the television receiver 1 is constituted by a speaker unit of a middle and high frequency range reproduction type. The speaker 4 disposed at the left side of the front panel is constituted by a speaker unit of an all frequency range reproduction type which is superior in reproduction characteristics of a low frequency range than that of the right side speaker 3. In this case, the speaker unit of the middle and high frequency range reproduction type constituting the right side speaker 3 has reproduction characteristics capable of reproducing sound of several hundreds Hz or more, and the speaker unit of the all frequency range reproduction type constituting the left side speaker 4 has reproduction characteristics capable of reproducing sound of several tens Hz or more. Each of the speaker units of the right and left side speakers 3 and 4 is constituted as a cone type speaker unit.

The speaker units constituting the speakers 3 and 4 are adapted to have substantially the same sound reproduction characteristics (sound pressure characteristics or the like) in the middle and high frequency range of several hundreds Hz or more. In general, the speaker unit of the all frequency range reproduction type constituting the left side speaker 4 is larger in diameter when compared with that of the speaker unit of the middle and high frequency range reproduction type constituting the right side speaker 3.

In this embodiment, the speaker unit of the all frequency range reproduction type constituting the left side speaker 4 is accommodated in a speaker cabinet 5. FIG. 2 shows a sectional view of the inner portions of the television receiver shown in FIG. 1. As shown in FIG. 2, the speaker cabinet 5 is extended to the space at the rear side of the cathode ray tube 2. A port 6 is provided at the portion beneath the speaker unit at the front panel of the speaker cabinet 5 so that the speaker 4 serves as a bass-reflex type speaker. That is, the air within the speaker cabinet 5 is phase-inverted and then radiated outwardly through the port 6. To be more concrete, sound radiated from the rear side of the speaker unit mounted at the speaker cabinet 5 is phase-inverted and then radiated outwardly through the port 6. Since the speaker 4 is thus constituted as the bass-reflex type speaker, reproduction efficiency of a low frequency range thereof can be improved.

A protective member (not shown) made of some suitable material such as a saran net or the like is disposed over each of the front faces of the right and left side speakers 3 and 4 so that neither the speaker units of the right and left side speakers nor the port 6 are seen directly from the front panel side of the television receiver.

Figure 3:
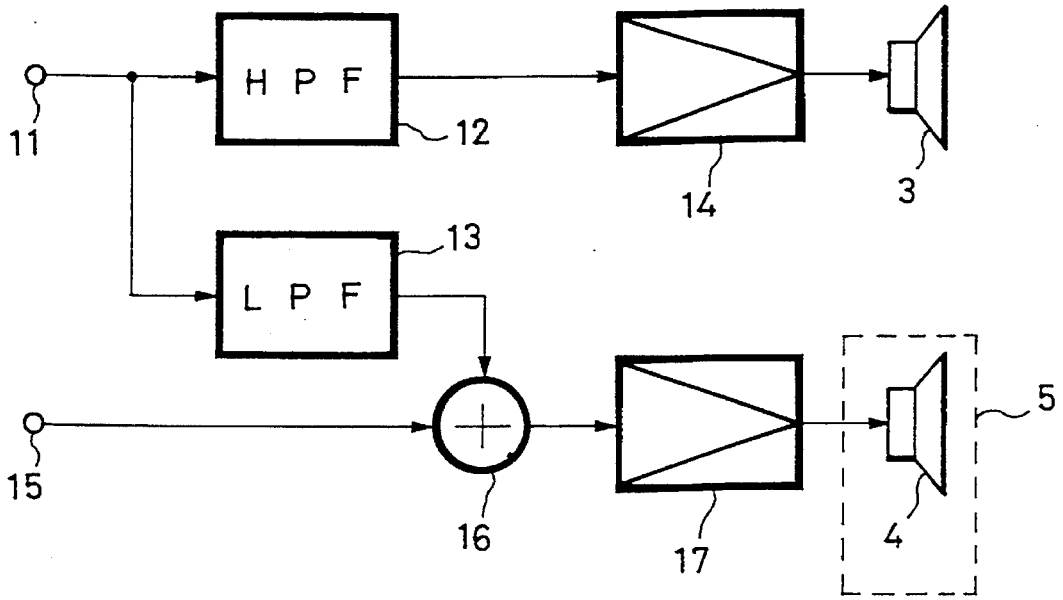
FIG. 3 shows in block form an arrangement of a stereo audio signal reproducing circuit according to the embodiment.

FIG. 3 shows a circuit arrangement for supplying the stereo audio signal to the right and left speakers 3 and 4. Referring to FIG. 3, the right channel audio signal applied to an input terminal 11 for the right channel audio signal is supplied to a power amplifier 14 through a high pass filter 12 and an amplified output of the power amplifier 14 is supplied to the speaker unit constituting the right side speaker 3. In this case, a cut-off frequency of the high pass filter 12 is set to be several hundreds Hz so as to coincide with the reproduction characteristics of the speaker unit constituting the right side speaker 3. The right channel audio signal applied to the input terminal 11 is also supplied to a low pass filter 13, which in turn supplies an output signal thereof to a mixer 16. A cut-off frequency of the low pass filter 13 is also set to be several hundreds Hz so as to extract a low frequency component which is not reproduced from the speaker unit constituting the right side speaker 3.

The left channel audio signal applied to an input terminal 15 for the left channel audio signal is supplied to the mixer 16, so that the low frequency component of the right channel audio signal is mixed with the left channel audio signal. An output audio signal of the mixer 16 is supplied a power amplifier 17 and an amplified output of the power amplifier 17 is supplied to the speaker unit constituting the left side speaker 4.

According to the thus constituted television receiver, when reproducing the stereo sound from the television receiver, the middle and high frequency components of the right channel audio signal are reproduced by the right side speaker 3, and all frequency range components of the left channel audio signal and the low frequency components of the right channel audio signal are reproduced by the left side speaker 4. When reproducing the stereo audio signal, the signal with directivity which influences on the stereo feeling is the relatively high frequency components, while the relatively low frequency components have almost no directivity and little influences on the stereo feeling. Accordingly, the stereo sound reproduction with presence can be performed so long as only the middle and high frequency components of the stereo audio signals are separately reproduced from the right and left side speakers. The stereo feeling can not be degraded even when the relatively low frequency components of the stereo audio signals are reproduced from only one of the right and left side speakers.

Although the television receiver according to the embodiment is constituted to perform good stereo sound reproduction as described above, only one of the right and left side speakers is required to employ a speaker unit which can reproduce the low frequency components as well as the middle and high frequency components with good quality. The other speaker may use a relatively cheap speaker unit which can reproduce only the middle and high frequency components. As a consequence, the television receiver which can reproduce the good stereo sound can be provided at a lower cost.

Further, according to the embodiment, the speaker cabinet required for good reproduction of the low frequency components may be provided for only one of the right and left side speakers, so that a size of the television receiver can be miniaturized when compared with that having two speaker cabinets for the right and left speakers.

While the all frequency range components are reproduced from the left side speaker and the middle and high frequency range components are reproduced from the right side speaker as described above, the television receiver may be arranged in a manner that the all frequency range components are reproduced from the right side speaker and the middle and high frequency range components are reproduced from the left side speaker.

Further, while the left side speaker is constituted as the bass-reflex type speaker as described above, the left side speaker may be accommodated in a speaker cabinet having no port or the left side speaker may not be accommodated in a speaker cabinet.

Furthermore, while the low frequency components of the right and left channel audio signals are mixed and reproduced from the speaker at which the low frequency components are reproduced as described above, the low frequency components may not be necessarily mixed. That is, since the low frequency components have no directivity originally, the low frequency components of the ordinary stereo audio signal are substantially same between the right and left channels. Accordingly, the circuit arrangement for mixing the low frequency components shown in FIG. 3 may be removed in a case of simplifying the circuit arrangement of the speakers.

As set out, according to the present invention, since only one of the at least two speakers which are required to reproduce the stereo sound is constituted by a speaker unit of the all frequency range reproduction type which is superior in reproduction characteristics of the low frequency components, the other speaker can be constituted by a speaker unit of the middle and high frequency range reproduction type which is relatively small in size and cheap. Accordingly, the speakers for the stereo reproduction used in the television receiver can be constituted with a lower cost and a smaller size. In this regard, when reproducing the stereo audio signal, the signal with directivity is the relatively high frequency components, while the relatively low frequency components have little directivity. Accordingly, the stereo feeling can not be degraded even when the relatively low frequency components of the stereo audio signals are reproduced from only one of the right and left side speakers.

Further, since the low frequency components of one of the right and left channel audio signals constituting the stereo audio signal are mixed with the audio signal of the other channel and the mixed audio signal is reproduced from the speaker unit constituting the other speaker corresponding to the other channel, the low frequency components of the right and left channels constituting the stereo sound can be reproduced with good quality.

Furthermore, since the speaker unit of the all frequency range reproduction type constituting the other speaker is accommodated in the speaker cabinet, the low frequency components can be reproduced with a high efficiency and good quality.

Having described the preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A television receiver including a cathode ray tube serving as an image display portion and having a funnel end, comprising at least a pair of speakers for reproducing stereo audio signals, wherein a first of said pair of speakers is arranged so as to reproduce middle and high frequency ranges of said stereo audio signals, and a second of said pair of speakers is arranged so as to reproduce all frequency ranges of said stereo audio signals, said second speaker being superior in reproduction characteristics of low frequency range audio signals than that of said first speaker and being arranged in a substantially L-shaped speaker cabinet extending from a front panel of the television receiver opposite said funnel end alongside said cathode ray tube toward a rear side thereof and transversely past said funnel end.

2. The television receiver according to claim 1, wherein said stereo audio signals are provided on a first and second channel, and wherein low frequency components of said first channel are mixed with all frequency components of said second channel, and the mixed audio signal is reproduced from said second speaker.

3. The television receiver according to claim 1, wherein said speaker cabinet has a port for phase-inverting inner air and radiating the phase-inverted air externally through said port.

4. The television receiver according to claim 1, wherein said pair of speakers are provided at right and left sides of the image display portion of the television receiver.

5. The television receiver according to claim 1, wherein said second speaker is arranged to reproduce stereo audio signals down to approximately 10 Hz.

6. The television receiver according to claim 5, wherein said first speaker is arranged to reproduce stereo audio signals down to approximately 100 Hz.

* * * * *